US005228425A

United States Patent [19]

Simons

[11] Patent Number: 5,228,425

[45] Date of Patent: Jul. 20, 1993

[54] IGNITION SYSTEM FOR INTERNAL COMBUSTION ENGINE

[76] Inventor: Sylvan Simons, 45 Don Bosco Pl., Port Chester, N.Y. 10573

[21] Appl. No.: 637,607

[22] Filed: Jan. 4, 1991

[51] Int. Cl.[5] ..... F02P 3/04

[52] U.S. Cl. ..... 123/620; 123/640; 123/643; 123/656

[58] Field of Search ..... 123/620, 640, 643, 655, 123/656

[56] References Cited

U.S. PATENT DOCUMENTS

| | | | |
|---|---|---|---|
| 3,452,733 | 7/1969 | Eckert | 123/620 |
| 3,910,247 | 10/1975 | Hartig | 123/643 |
| 3,919,993 | 11/1975 | Neuman | 123/620 |
| 4,136,301 | 1/1979 | Shimojo et al. | 123/620 X |
| 4,409,952 | 10/1983 | Canup | 123/620 |
| 4,556,040 | 12/1985 | Heyke | 123/656 X |
| 4,558,685 | 12/1985 | Ishikawa et al. | 123/620 |
| 4,915,087 | 4/1990 | Boyer | 123/620 |

*Primary Examiner*—Tony M. Argenbright
*Attorney, Agent, or Firm*—Alfred E. Miller

[57] ABSTRACT

An inductive discharge ignition system for an internal combustion engine uses two ignition transformers with their associated circuitry. One transformer is employed in a Kettering type high voltage system. The other transformer is used in a low voltage high current output system. The Kettering system initiates spark plug arcing. When the arc is established the lower voltage high current circuit increases the arcing since only lower voltage is needed to sustain or increase the arcing once arcing is established.

20 Claims, 5 Drawing Sheets

1800 RPM

15 MA STANARD IGNITION SYSTEM

IGNITION SYSTEM DESCRIBED

IGNITION SYSTEM FOR INTERNAL COMBUSTION ENGINE

FIELD OF THE INVENTION

This invention relates to improvements in ignition systems for internal combustion engines, and is directed in particular to such systems wherein an arc is initially struck by a high voltage system, and is maintained by a high current low voltage system.

BACKGROUND OF THE INVENTION

Since the efficiency of a spark ignited internal combustion engine is affected by the amount of spark generated by the ignition system, much effort has been directed to improve on the almost universal use of the Kettering high voltage system.

Neuman U.S. Pat. No. 3,919,993, discloses a dual action ignition system in which the first inductive discharge Kettering circuit initiates spark plug arcing and a second inductive discharge high current low voltage circuit increases the arcing. The two circuits are separated by two "steering diodes" which are necessarily high voltage rectifiers.

These high voltage rectifiers are "strings" of individually selected and matched diodes which are then assembled. They are necessarily expensive with questionable durability since the characteristics of individual diodes will change with temperature and aging.

SUMMARY OF THE INVENTION

It is an object of my invention to provide an ignition system that overcomes the above disadvantages of known systems in an economical and efficient manner.

Briefly stated, my invention comprises an ignition system for an internal combustion engine, comprised of a first source of electric power having an output of high voltage and a second source of electric power having an output of higher current and lower voltage than said first source. The first source outputs a voltage sufficient to strike an arc in an ignition device of the engine and the second source outputs a current for increasing the arcing in said device by increasing the electrical energy dissipated in said device. In accordance with the invention the outputs of the two sources are connected in series.

The sources may be comprised of output transformers having their secondary windings connected in series. A poled diode arrangement is preferably connected in parallel with the secondary winding of the higher voltage transformer, but not the other transformer.

The poled diode arrangement may comprise separate diodes connected between taps of the secondary winding of the higher voltage transformer, via resistors if diode load dissipates excessive power. Alternatively, the first source may include a plurality of transformers having serially connected secondary windings, with the diode arrangement including a separate diode connected in parallel with each secondary winding of the first source.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
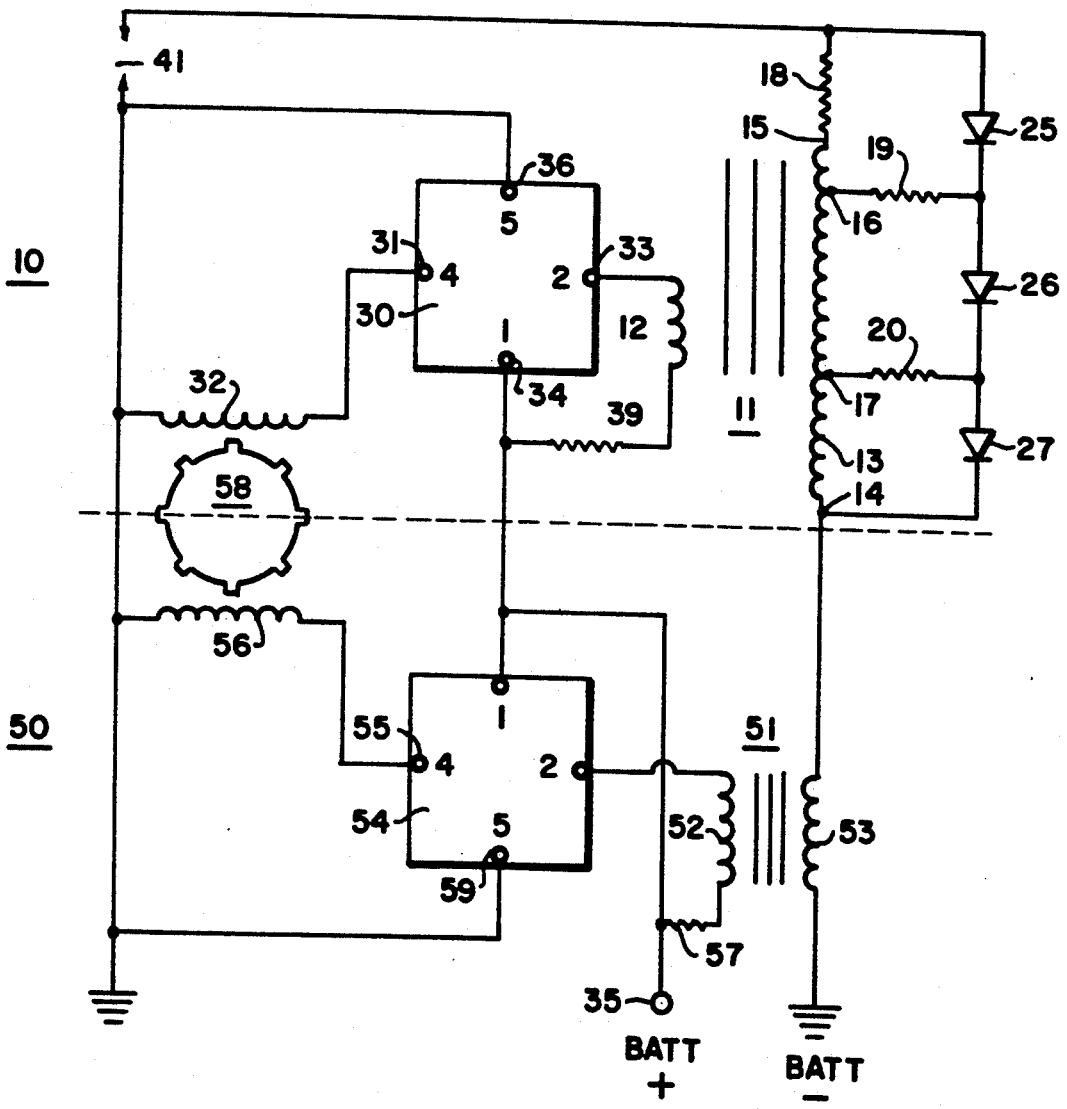
FIG. 1 is a circuit diagram of an ignition system in accordance with one embodiment of my invention.

Referring now to FIG. 1, in accordance with one embodiment of my invention, an ignition circuit includes a high voltage circuit 10 that is similar in many respects to a generally conventional Kettering ignition circuit (above the dashed line) including a Kettering type high voltage transformer 11 having a primary winding 12 and a secondary winding 13. The high voltage winding has first and second ends 14, 15, and intermediate taps 16, 17. One end of a resistor 18 is connected to the end 15 of the high voltage, one end of a resistor 19 is connected to the tap 16 and one end of a resistor 20 is connected to the tap 17. A diode 25 is connected between the other ends of resistors 18 and 19, a diode 26 is connected between the other ends of resistors 18 and 19, and a diode 27 is connected between the other end of the resistor 20 and the low voltage end 14 of the high voltage winding. These diodes are poled with their anodes directed toward the high voltage end 15 of the winding 13.

The circuit 10 further includes an ignition module 30, which is essentially a pulse shaper and amplifier, having an input terminal 31 connected to an inductive pickup coil 32 and a output 33 connected to one end of the primary winding 12. The supply terminal 34 of the module 30 is connected to a battery terminal 35, for connection for example to the positive terminal of a 12 volt battery, and the ground terminal 36 of the module is connected to ground reference. The other end of the primary winding 12 is also connected to the battery terminal 35, via a resistor 39. The junction of the resistor 18 and the diode 25 is connected to the high voltage terminal of a spark plug 41, the other terminal thereof being grounded.

The ignition circuit of FIG. 1 further includes a low voltage high current circuit 50 (below the dashed line) that includes a low voltage high current transformer 51 with a primary winding 52 and a secondary winding 53. A further pulse shaping and amplifying module 54, similar to or the same as the module 30, has an input 55 connected to receive pulses from a pickup coil 56 and an output connected to the primary winding 52. The other end of the primary winding 52 is connected to the battery terminal via a resistor 57. The supply terminal of the module 54 is connected to the battery terminal 35, and the return terminal 59 thereof is grounded. The secondary winding 53 of the transformer 51 is connected in series with the secondary winding 13 of the high voltage transformer.

The pickup coils 32 and 56 are coupled to a reluctor wheel 58 which turns with distributor rotor, in order to generate pulse trains responsive to the rotation of the wheel 58.

In comparison with the dual action ignition system of U.S. Pat. No. 3,919,993, which employs a diode rectifier string in both the high and low voltage circuits, the arrangement of my invention as illustrated in FIG. 1 requires only one string of diodes comprised of diodes 25, 26 and 27, and does not require such diodes in the low voltage circuit.

The diodes do not have to be matched because the voltage applied to them is determined by the voltage at transformer taps, as compared to "string" diodes of Neuman where division of high voltage depends on electrical characteristics of other diodes in the "string".

In one embodiment of my invention, the primary winding 12 has 60 turns of #18 wire on a ⅞ inch core, and the secondary winding 16 has 48 layers of 118 turns each #29 wire with leads brought out every 16 layers to the taps 16 and 17, respectively. Each of the resistors 19 and 20 consists of a string of seven 2 watt 4800 ohm resistors, for a total of approximately 33,000 ohms. Since 2 watt resistors are insulated against breakdown for 750 volts, the "string" can withstand more than 5,000 volts. The resistors 18 and 57 are 1.1 ohm Chrysler ignition ballast resistors. Such ballast resistors are commonly used with ignition coils where the resistor's temperature-resistance characteristics help to compensate for battery voltage reduction when the starter is engaged. The diodes 25, 26 and 27 are FAGOR 12,000 Volt #HVR 3-12, i.e. currently available devices having a nominal cost.

The transformer 51 is a Stancor #P8619 transformer with a 24 volt winding connected as the primary and 230 volt winding connected as the secondary.

Figure 5:
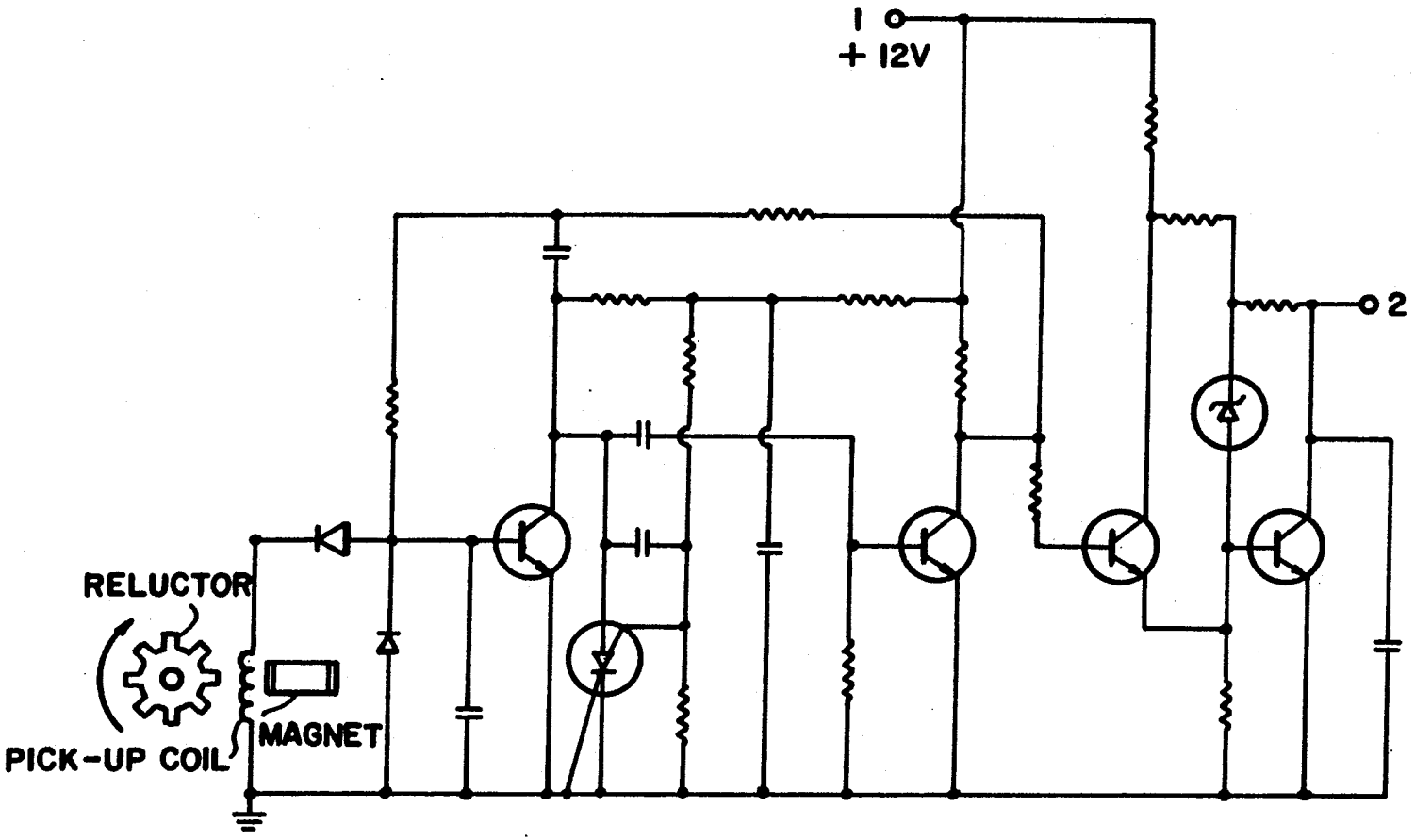
FIG.5 PRIOR ART
FIG. 5 is a circuit diagram of a known ignition module.

The modules 30 and 54 are Chrysler Motors ignition coil actuators for the high voltage transformer 13 and the high current transformer 51, respectively. The circuit diagram of this module, in combination with a pickup coil and reluctor, is illustrated in FIG. 5, in order to enable a better understanding of these devices.

In the circuit of FIG. 1, the output of the transformer 13 contains transients and other undesirable outputs. The resistors 19 and 20 reduce the effect of such undesirable outputs. In addition, these resistors reduce reverse currents in the diode which produce heating of the diode.

In operation, when the actuator module 30 turns off current in primary winding 14, the inductive field in transformer 11 collapses, thereby generating a high voltage to cause arcing in the spark plug 41.

The pick up coils are arranged so that, at the same time, the actuator 54 turns off current to primary winding of transformer 51 resulting in the discharge of current due to the collapsing field, through poled diodes 25, 26 and 27, to increase the arcing at spark plug 41.

Figure 2:
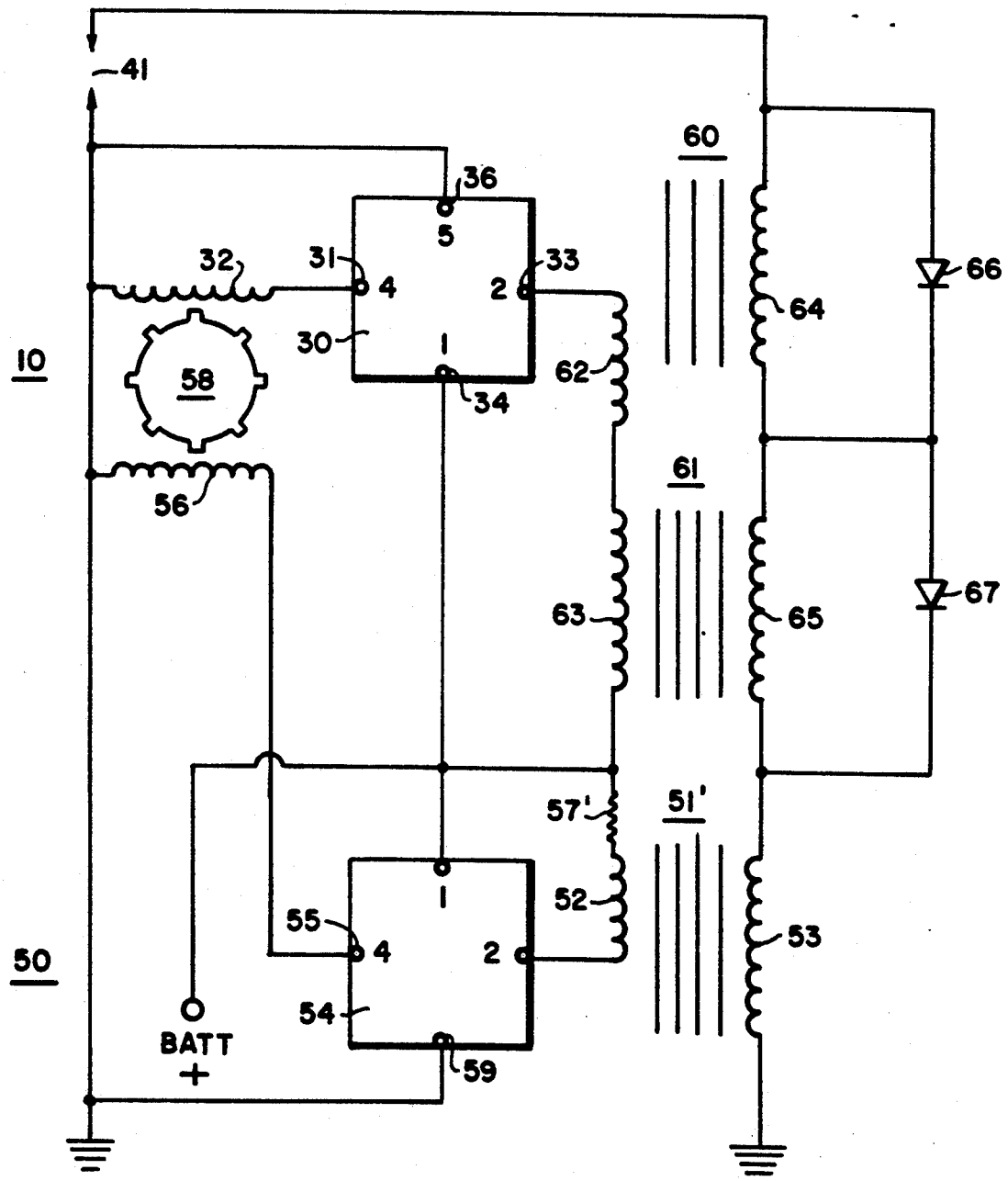
FIG. 2 is a circuit diagram of a modification of the system of FIG. 1.

In an alternate arrangement of the invention, as illustrated in FIG. 2, the ignition circuit employs two General Motors ignition transformers 60, 61 with their primary windings 62, 63 connected in series and their secondary windings 64, 65 also connected in series. A diode 66 is connected directly in parallel with the secondary winding 64, and a diode 67 is connected directly in parallel with the winding 65. Since the two transformers are connected in series, the diodes are subjected to only half of the generated high voltage. Since the resistance of each secondary winding is approximately 8,000 ohms, it is possible to dispense with the diode resistors employed in the circuit of FIG. 1.

The further elements of the circuit of FIG. 2, which have reference numerals also employed in FIG. 1, refer to the same devices as in the circuit of FIG. 1.

Figure 3:
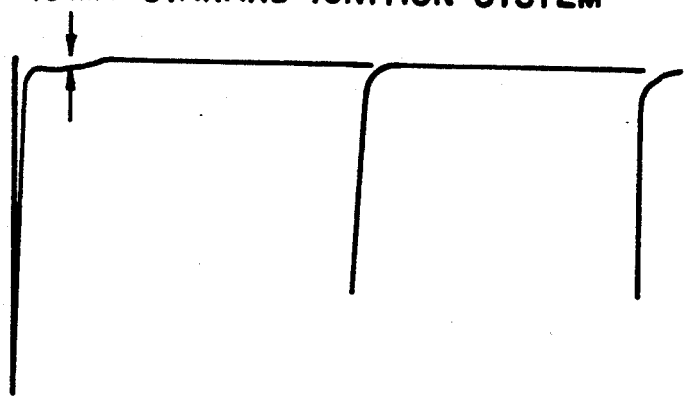
FIG.3 PRIOR ART
FIG. 3 illustrates a current waveform of a conventional Kettering system.
Figure 4:
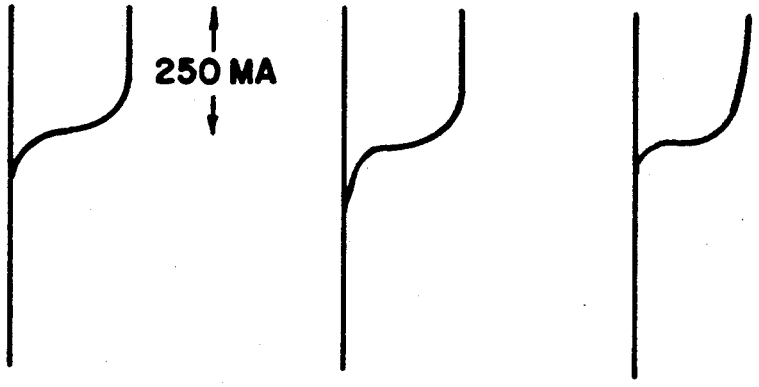
FIG. 4 illustrates a current waveform of the system of my invention.

FIG. 3 illustrates the waveform of the electric current in a spark plug employing a conventional Kettering ignition system, as view on the screen of an oscilloscope connected to such a circuit. The engine was running at about 3600 Rpm, resulting in a pulse repetition rate of about 60 Hz. FIG. 4, on the other hand, illustrates the waveform of the current in a spark plug using ignition system of FIG. 1 of my invention, under similar conditions, as viewed on the screen of an oscilloscope. Wave forms of the type illustrated in FIG. 4 were obtained up to speeds of the engine corresponding to about 60 Mph. These figures show that my invention provides a substantial increase in the spark plug energy.

Distributorless ignition systems are appearing in a large percentage of American manufactured automobiles. Obviously, designers believe that its attributes outweigh the disadvantages of the system. Such disadvantages include the fact that half of the sparks developed are not used, and in addition half of the firing is effected with the center spark plug electrode wrongly (positively) polarized. As a consequence, the arcing is not optimum as compared to the older distributor type ignition distribution. The use of the teachings of my invention, however, can overcome the above noted deficiencies of distributorless ignition systems.

Figure 6:
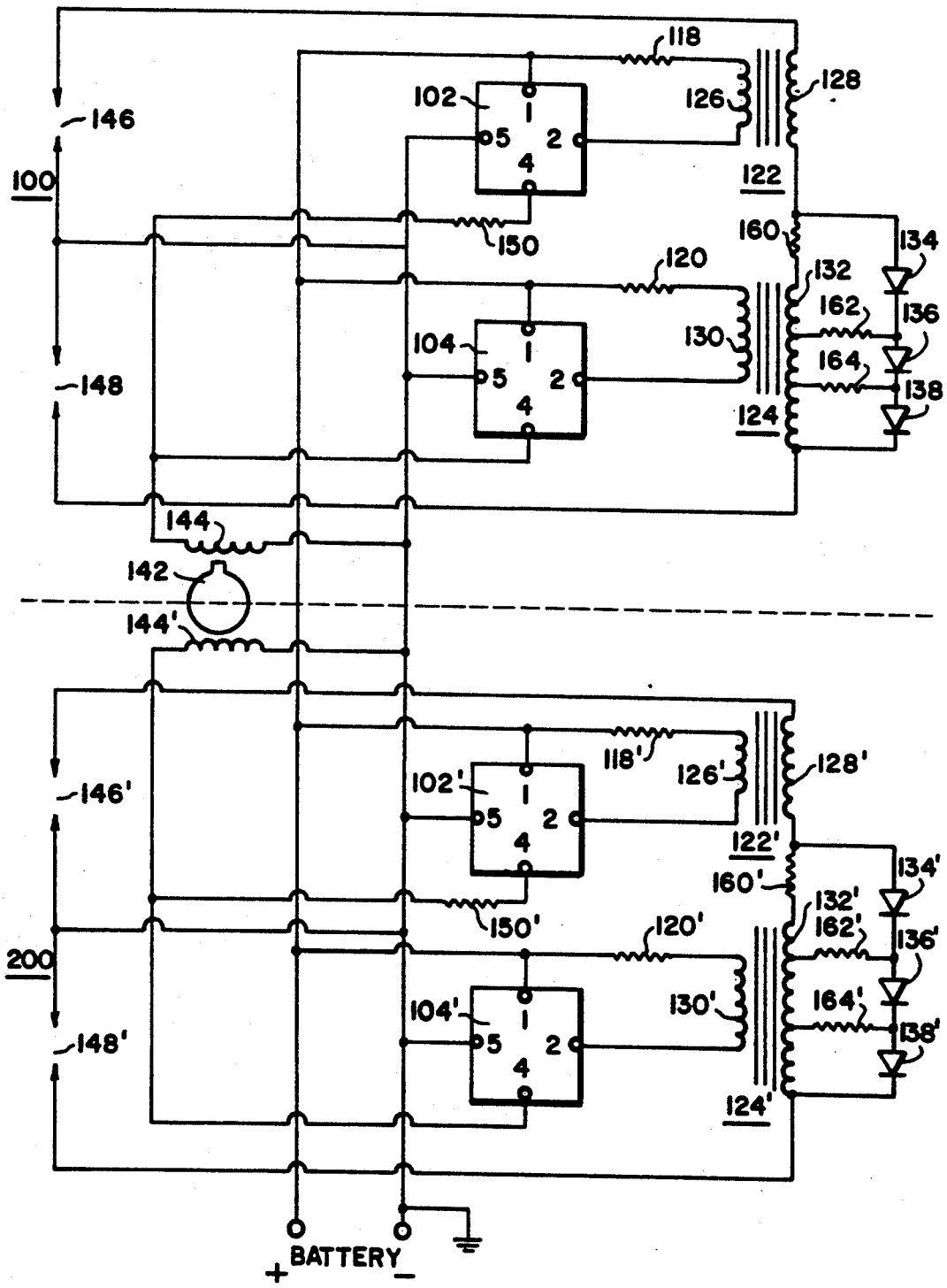
FIG. 6 is a circuit diagram of a further modification of the system of FIG. 1, especially adapted for a distributorless ignition system.

Referring now to FIG. 6, sensors 144 and 144' are positioned to sense the rotations of a rotor 142 rotating in unison with the engine. Alternatively, if an automobile is to be refit to use a distributor, the reference numeral 142 may be considered to comprise a reluctor, such as the reluctor of a Chrysler with all of its teeth, except two opposed teeth, removed. In this case the two remaining teeth are used on the distributor shaft as it rotates at half engine speed. Also in this case, the sensors 144 and 144' are positioned ¼ turns apart, instead of ¼ turn apart as illustrated for a conventional distributorless system.

In either event, one pulse is generated in each pickup coil 144, 144' with each half revolution of the engine, to cause arcing of series connected spark plugs 146, 148, or 146, 148'. The opposite electrode of each of these spark plugs is grounded. These pulses are applied respectively to pins 4 of the modules 104, 104', and the outputs from these modules at their respective pins 2 are applied to one end of the primary windings 130, 130' of the high voltage ignition transformers 124, 124' respectively to produce the high voltage at the respective secondary windings 132. 132' necessary to strike an arc. Supply voltage is applied to the pins 1 of the modules 104, 104'.

At the same time, the pulses from pick up coils 144, 144' are applied to the input pins 4 of the ignition modules 102, 102', but these pulses are delayed by the inclusion of series resistors 150, 150' in this connection. The outputs of the modules 102, 102', at pins 2 thereon, are applied to the primary windings 126, 126' of lower voltage higher current transformers 122, 122' (as compared with the tranformers 124, 124'). The secondary windings 128, 128' of the transformers 122, 122' are connected in series with the secondary windings 132, 132' of the transformers 124, 124'. These lower voltage transformers are thus actuated to increase the spark plug current and arcing. A string of diodes 134, 136, 138, and 134', 136, 138' is connected in parallel with the secondary winding 132, 132, of each of the high voltage transformers 124, 124', to provide a low impedance path for the higher current from the secondary windings of the transformers 122, 122'. The anodes of these resistors are connected to one end, and taps of the secondary windings of the high voltage transformer, via resistors 160, 162, 164 and 160', 162', 164', respectively, to reduce reverse current flow through the diodes. Depending upon the characteristics of the diodes, these resistors may be eliminated if the resistance of the high voltage transformer secondary winding is sufficiently high.

Resistors 118, 120 and 118', 120', in series with the return lead of the primary windings of the transformers, are "ballast" resistors commonly used with ignition transformers to limit current flow.

In a two cylinder engine such as for example a motorcycle engine, only one half of the circuit of FIG. 6 is used, such as only the upper half thereof. Conversely, in an engine with more the four cylinders, additional half sections of the type illustrated in FIG. 6 may be used, with additional pick up coils and teeth on rotating rotor or reluctor.

As discussed above, distributorless ignition systems waste one half of the arcings. Although two spark plugs are fired every time the engine calls for spark plug actuation, only one cylinder is approaching the power stroke. Consequently, the spark applied to the opposite sparked cylinder is wasted since this opposite cylinder is completing the exhaust stroke at that time. This fact is not of concern to the present invention, however, but is inherent with the usual distributorless ignition systems.

In one example of the invention, the modules 102, 104, 102' and 104' were Chrysler Motors ignition modules, ballast resistors were Chrysler 1.1 ohm ballast resistors, transformers 122, 122' were Thordarsen 26F60, 117 volt primary and 6.3 volt secondary, with 10,000 volt (7,000 volt RMS) insulation, with the 6.3 volt winding being used for the primary windings 126 and 126'. Transformers 124 and 124' were the same transformers as employed for the transformer 11 of the circuit of FIG. 1, and the diodes 134, 135 and 136 were also be the same as those used in the circuit of FIG. 1 (i.e. Fagor type HVR 3-12). Input resistors 150 and 150'' were one half watt 500 ohm resistors. Resistors 160, 160', 162, 162', 164 and 164' were each comprised of seven 2 watt 4800 ohm resistors.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. In an ignition system for an internal combustion engine, comprised of a first source of electric power having an output of high voltage and a second source of electric power having an output of higher current and lower voltage than said first source, whereby said first source outputs a voltage sufficient to strike an arc in an ignition device of the engine and the second source outputs a current for increasing the arcing in said device by increasing the electrical energy dissipated in said device, the improvement comprising means for serially connecting the outputs of said first and second sources, and diodes means connected in parallel with said output of said first source to provide a low impedance path for electric current of said second source.

2. The ignition system of claim 1 wherein said first source comprises a Kettering type inductive discharge high voltage low current transformer having a secondary winding connected in series with said second source, and said diode means comprises at least one poled diode connected in parallel with said secondary winding of said high voltage transformer output.

3. The ignition system of claim 2 comprising at least one tap on said secondary winding, thereby dividing said secondary winding into a plurality of sections, said diode means comprising a separate diode coupled in parallel with each of said sections, said diodes having reverse breakdown voltages lower that the total output voltage of said secondary winding.

4. The ignition system of claim 3 further comprising a separate resistor connected in series between each said tap and the respective diode connected thereto, thereby reducing reverse current in said diode.

5. The ignition system of claim 1 wherein the outputs of said first and second sources comprise transformers having secondary windings, and said secondary windings are connected in series.

6. The ignition system of claim 5 wherein said second source comprises a transformer having a secondary winding connected in series with the secondary windings of said first source.

7. The ignition system of claim 5 wherein said transformers have primary windings connected in series.

8. The ignition system of claim 5 wherein said transformers have primary windings connected in parallel.

9. The ignition system of claim 7 wherein said second source comprises a transformer having a primary winding connected in series with said primary windings.

10. The ignition system of claim 1 wherein said first source comprises first and second transformers having series connected secondary windings, and said diode means comprises a separate poled diode connected in parallel with the secondary winding of each of said transformers.

11. An ignition circuit for an internal combustion engine, comprising first and second pulse shaping and amplifying circuits, means applying pulses to said pulse shaping and amplifying circuits responsive to rotation of said engine, first and second transformers having primary windings coupled to the outputs of said first and second pulse shaping and amplifying circuits, respectively, said transformers having secondary windings, means connecting said secondary windings in series, and poled diode means connected in parallel with the secondary winding of said first transformer, said second transformer output having a lower voltage and higher current than said first transformer.

12. The ignition circuit of claim 11 further comprising a third transformer having secondary windings connected in series with the secondary winding of said first transformer, respectively, and said diode means comprises separate diodes connected in parallel with the secondary windings of said first and third transformers.

13. The ignition circuit of claim 11 wherein said secondary winding of said first transformer is sectioned by taps, and poled diode means are connected across each section by said taps.

14. The ignition circuit of claim 11 wherein resistance is inserted between said diodes and said taps.

15. The ignition circuit of claim 11 comprising means for delaying the response of said second pulse shaping and amplifying circuit to insure that the output of said second circuit is timed to reinforce arcing initiated by said first circuit.

16. The ignition system of claim 15 wherein said delay means comprises series resistance means for delaying triggering of said second circuit.

17. A distributorless ignition system for an internal combustion engine comprising a high voltage source with opposite terminals connected to the high voltage terminals of first and second spark plugs, a common ground connection connected to said spark plugs to complete a high voltage circuit, and means for overcoming unequal arcing of the first and second spark plugs caused by the application of high voltage of opposite polarity thereto from said source.

18. A distributorless ignition system for an internal combustion engine comprising a high voltage source having opposite terminals separately connected to the high voltage terminals of first and second spark plugs, a common ground connection connected to said spark plugs to complete a high voltage circuit, and means for increasing the arcing intensity in said spark plugs as compared with that provided by said high voltage source.

19. The distributorless ignition system for an internal combustion engine of claim 18, wherein said means for increasing the arcing in the spark plugs comprises a transformer that has a higher current lower voltage output than said high voltage source, the secondary winding of said transformer being connected in series with the high voltage source, and further comprising diode means connected in parallel with the high voltage source to provide a low impedance path for the output of said transformer, and pulse generating and shaping and amplifying circuits coupled to the primary winding of said transformer to increase spark plug arcing and minimize the effect of the application of opposite polarity high voltages to said spark plugs by said source.

20. The distributorless ignition system for an internal combustion of claim 18 wherein said high voltage source comprises a high voltage transformer, and said means for increasing the arcing intensity comprises a second transformer having a higher current lower voltage output than said high voltage transformer, the secondary windings of said transformers being connected in series, and further comprising diode means connected in parallel with the secondary winding of said high voltage transformer to provide a low impedance path for the output of said second higher current transformer, and a pulse generating, shaping, and amplifying circuit connected to the primary winding of said second transformer to actuate said second transformer to increase the current and the arcing of the spark plugs initiated by said high voltage transformer.

* * * * *